United States Patent [19]

Scott et al.

[11] 4,198,047

[45] Apr. 15, 1980

[54] MULTI COMPARTMENT GAME BOARD

[75] Inventors: Henry J. Scott; Lenore Scott, both of New York, N.Y.

[73] Assignee: Anjar, Inc., New York, N.Y.

[21] Appl. No.: 931,475

[22] Filed: Aug. 7, 1978

[51] Int. Cl.[2] ..... A63F 7/04

[52] U.S. Cl. ..... 273/1 R; 273/115; 273/138 R

[58] Field of Search ..... 273/138 R, 138 A, 139, 273/144 R, 144 A, 144 B, 123 R, 123 A, 124 R, 124 A, 113, 115

[56] References Cited

U.S. PATENT DOCUMENTS

| | | | |
|---|---|---|---|
| 2,601,985 | 7/1952 | Yerkes | 273/138 R X |
| 3,113,778 | 12/1963 | Silverman | 273/139 |
| 3,961,793 | 6/1976 | Zanders | 273/124 R |

FOREIGN PATENT DOCUMENTS

| | | | |
|---|---|---|---|
| 121801 | 12/1918 | United Kingdom | 273/144 B |
| 1418690 | 12/1975 | United Kingdom | 273/138 R |

*Primary Examiner*—Richard C. Pinkham
*Assistant Examiner*—Arnold W. Kramer
*Attorney, Agent, or Firm*—Charles E. Temko

[57] ABSTRACT

A composite game board comprising a base wall, a peripheral wall surrounding said base wall, a single septum extending between oppositely disposed portions of said peripheral wall to form a pair of chambers, one substantially larger in total area than the other, and a transparent upper wall substantially sealing said chambers. Each of said chambers is subdivided to form a plurality of compartments by walls or other projections, the heights of which are substantially less than the height of said chambers. Each of the compartments in the larger of the two chambers is identified by a letter of the alphabet or similar indicia. The compartments of the smaller chambers are provided with indicia, preferably in pictorial form, identifying a particular category of subject matter or other subject limitation. A single playing piece is disposed in the smaller chamber, and one or more similar pieces are disposed in the larger chamber. In use, the board is shaken to impart motion to the playing pieces, which subsequently come to rest in random fashion within the individual compartments to identify a particular category in the smaller chamber, and the selection of one or more letters which are used to form words applicable to the identified category by each of one or more players within a predetermined time span.

1 Claim, 3 Drawing Figures

MULTI COMPARTMENT GAME BOARD

BACKGROUND OF THE INVENTION

This invention relates generally to the field of parlor games, and more particularly to an alphabet type game in which the players record as many words as possible within a predetermined time span given certain limitations upon the selection of words; and more particularly to an improved means for conveniently determining a particular set of limitations from a larger group of available categories. Games of this general type are known in the art, and the invention lies in specific constructional details which permit low cost of manufacture, ease of use, and absolute random selection comparable to the throwing of dice.

Prior art games have been conducted without the use of other than printed instructions. When appearing in newspapers, for example, on the same page which carries crossword puzzles, chess diagrams and the like, it is common only to indicate a particular code word, and offer the reader the opportunity to form as many words of given length or greater which contain at least some of the letters in the code words. Such games can be played by either single or multiple players. However, unless a plurality of code words are printed, no random selection is possible, and when the single game offered has been completed, the player must wait for tomorrow's newspaper.

SUMMARY OF THE INVENTION

Briefly stated, the invention contemplates the provision of a game board, preferably formed of transparent synthetic resinous materials. The board includes upper and lower horizontal walls surrounded by a peripheral wall. A septum interconnects a pair of oppositely disposed portions of the peripheral wall to divide the interior of the board into a pair of generally rectangular chambers, one of which is preferably larger than the other. The chambers are further subdivided by low walls or other projections into a plurality of compartments, each capable of retaining a playing piece which may be in the form of a sphere, marble, or flat chip. Each compartment of the smaller chamber is identified, preferably graphically, to indicate a particular category of subject matter or other limitation. Each of the compartments in the larger chamber is identified by a letter of the alphabet, or similar character. In use, the board, with one or more playing pieces in each chamber is manually shaken, and the pieces are allowed to come to rest within a particular compartment. In one chamber, one or more particular categories of subject matter or other limitation are indicated. In the other chamber, the first or other letters of permissible words related to the selected category are indicated. Using a suitable timing device such as an hour glass or the like, each of the players may record words related to the selected category containing the selected letters over a predetermined period of time, following which scoring is based upon the number of words recorded.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
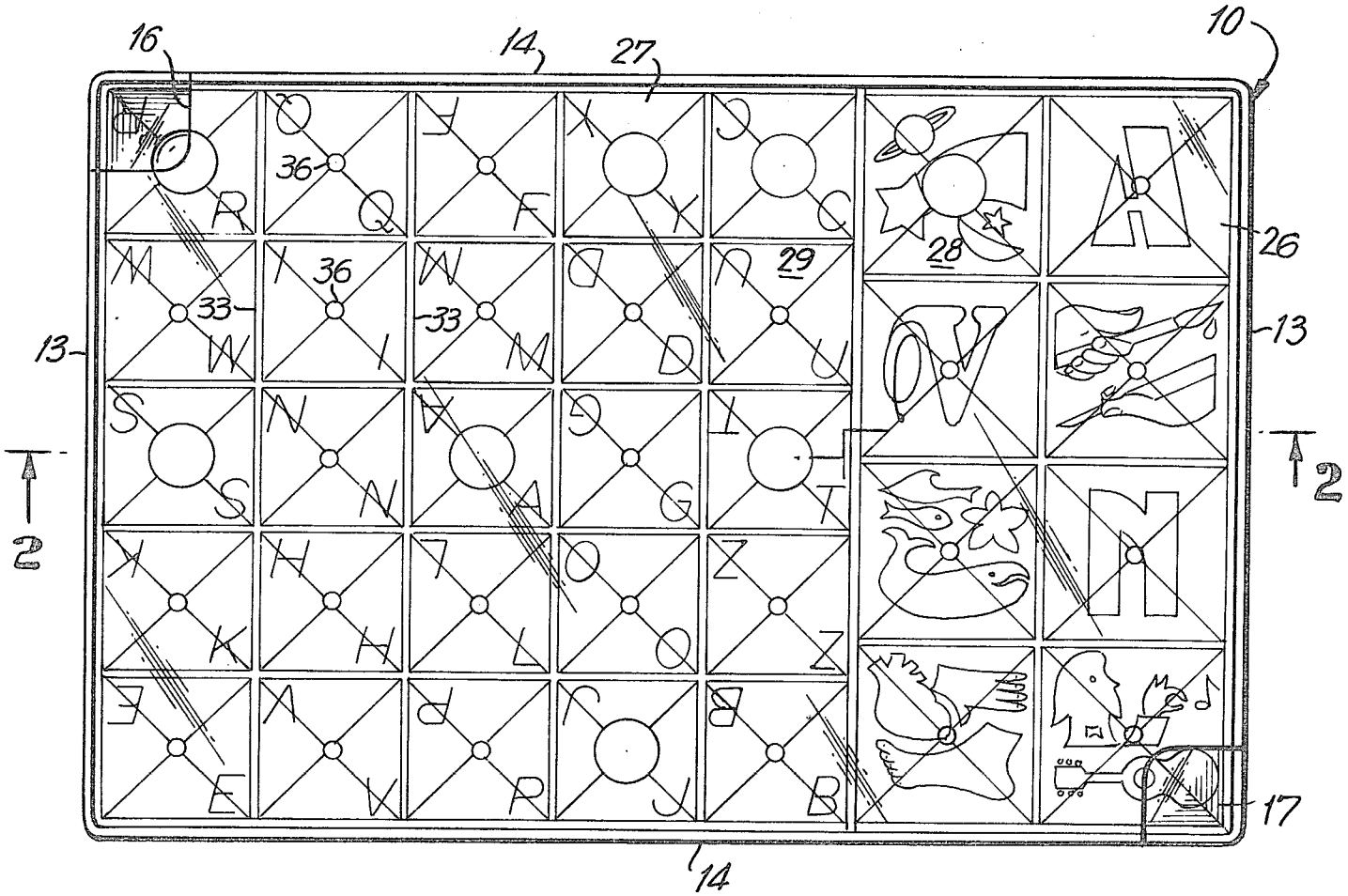
FIG. 1 is a top plan view of an embodiment of the invention.
Figure 2:
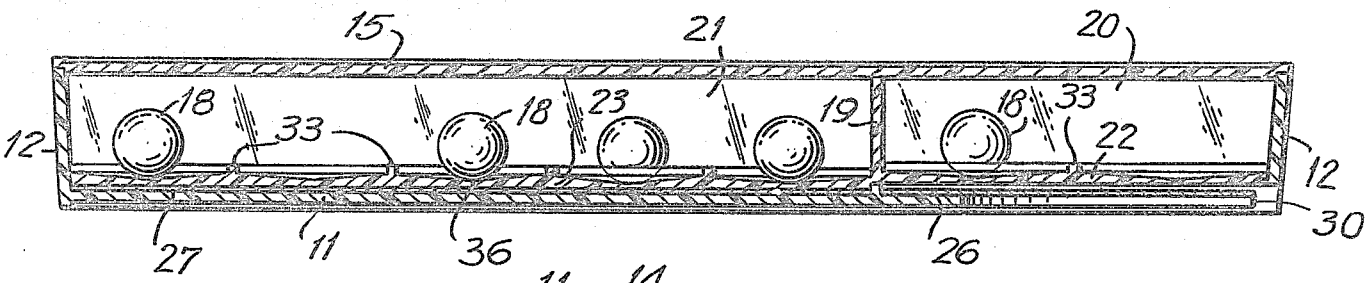
FIG. 2 is a transverse sectional view thereof as seen from the plane 2—2 in FIG. 1.
Figure 3:
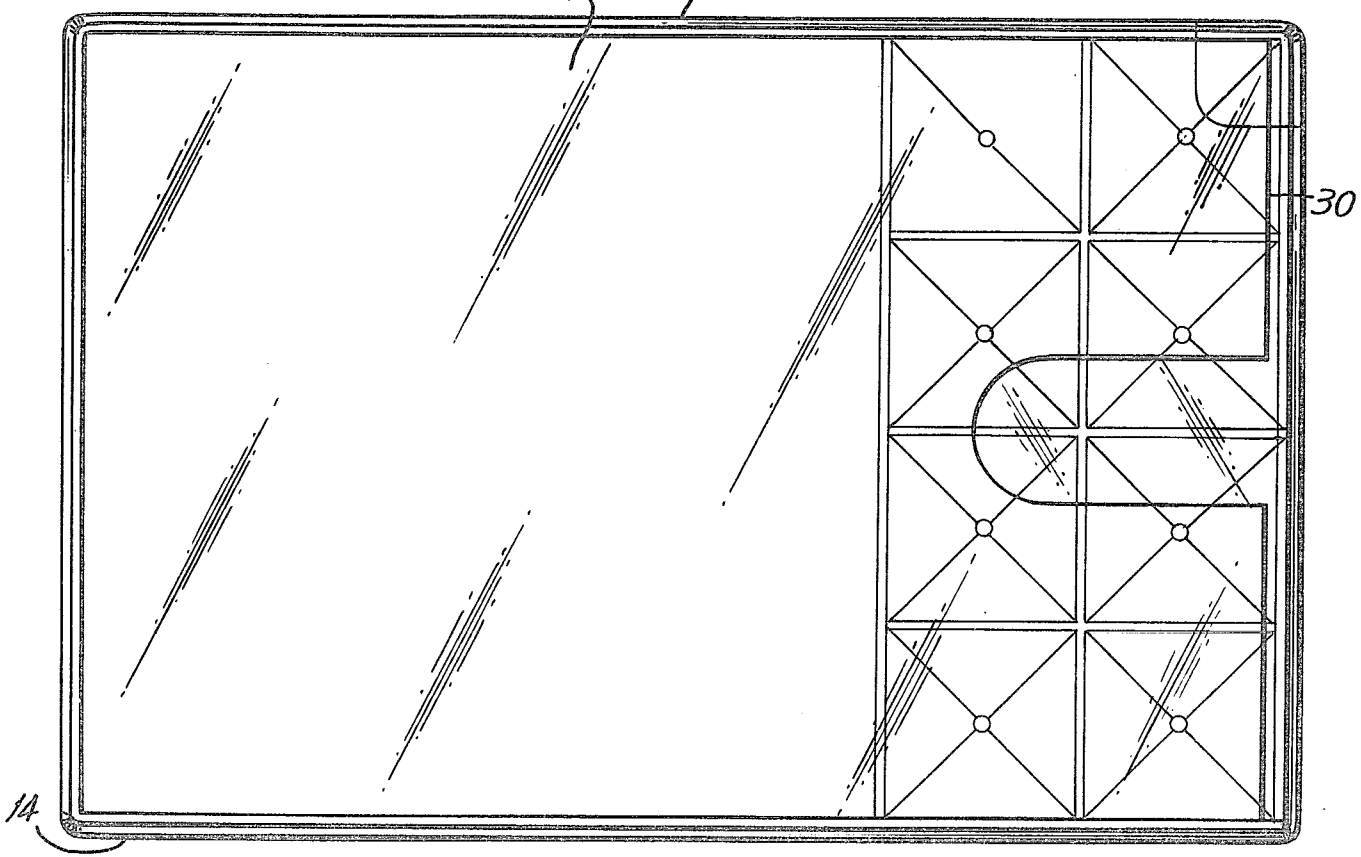
FIG. 3 is a bottom plan view thereof with an interchangeable category indicating element removed for purposes of clarity.

In accordance with the invention, the device, generally indicated by reference character 10, is of molded hollow configuration, preferably formed of synthetic resinous transparent materials. It includes a lower base wall 11, a continuous peripheral wall 12, including shorter segments 13 and longer segments 14, and an upper wall 15 forming a cover. The cover includes first and second openings 16 and 17 for the introduction of playing pieces 18, which are preferably in the form of spheres or marbles, although they may also be in the form of flat circular chips (not shown).

Interconnecting the longer segments 14 is an internal septum 19 defining a first smaller compartment 20 and a second larger compartment 21.

Within the compartments 20 and 21 are lower interior walls 22 and 23 defining interstices for the retention of indicia cards 26 and 27, each of which are divided into smaller rectangular areas 28 and 29, respectively. A slot 30 is provided along the lower edge of one of the shorter segments 13 to provide access to the interstice 24 for replacement of the indicia card 26.

In each of the compartments 20, 21, the upper surface of the lower interior walls 22 and 23 mount interconnected low walls 33 which divide each of the chambers into generally rectangular compartments 33, the enclosed portions of the upper service of the walls being divided into sloping pie-shaped parts which conduct a playing piece 18 to the center 36 of an individual compartment, where the playing piece is spherically shaped.

OPERATION

Operation of the device will be apparent from a consideration of the drawing. The playing pieces 18 are introduced through the openings 16 and 17 to place them within the compartments 20 and 21, respectively. The device is then shaken, as with a dice cup, and placed on a horizontal surface, wherein the playing pieces will come to rest in individual areas 28 and 29, respectively. The first compartment 20 will indicate a particular category, and the second a series of letters or other indicia which are to be included in words formed by the players for recording which relate to the selected category. At period intervals, the card 26 in the compartment 20 may be inverted or completely replaced to enlarge the field of permissible categories for play.

We wish it to be understood that we do not consider the invention limited to the precise details of structure shown and set forth in this specification, for obvious modifications will occur to those skilled in the art to which the invention pertains.

We claim:

1. A composite game board comprising: a planar base wall, a peripheral wall surrounding said base wall, a septum interconnecting a pair of mutually spaced portions of said peripheral wall, thereby forming first and second chambers, an upper wall supported by said peripheral wall and enclosing said chambers, each of said chambers being subdivided to form a plurality of compartments, the height of which is substantially less than the height of said chambers, so as to allow access from above; said second chamber having a transparent intermediate lower wall defining an interstice with said base wall, said peripheral wall defining a slot communicating with said interstice; a planar indicia card selectively insertable through said slot into said interstice, to underlie said second chamber, and provide a plurality of pictorial indicia, each indicia underlying a compartment in said second chamber; the compartments of said first chamber being identified by an alphabetic letter; a plurality of movable playing pieces disposed in said first chamber, a single playing piece being disposed in said second chamber; said device being agitated to effect a random selection of one compartment in said second chamber, and a plurality of compartments in said first chamber.

* * * * *